US006569614B1

(12) United States Patent
Shoji

(10) Patent No.: US 6,569,614 B1
(45) Date of Patent: May 27, 2003

(54) TRANSMISSION HEAT-DEVELOPMENT PHOTOSENSITIVE MATERIAL

(75) Inventor: Takashi Shoji, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/372,048

(22) Filed: Aug. 11, 1999

(30) Foreign Application Priority Data

Aug. 13, 1998 (JP) ..... 10-228993

(51) Int. Cl.[7] ..... G03C 1/498

(52) U.S. Cl. ..... 430/619; 430/350; 430/510; 430/531; 430/945

(58) Field of Search ..... 430/619, 617, 430/510, 350, 360, 531, 945

(56) References Cited

U.S. PATENT DOCUMENTS 4,581,323 A * 4/1986 Fisher et al. ..... 430/513
5,395,747 A 3/1995 Helland et al.
5,563,030 A * 10/1996 Zou et al. ..... 430/619

FOREIGN PATENT DOCUMENTS

| | | |
|---|---|---|
| EP | 0 505 155 A | 9/1992 |
| EP | 0 559 101 A1 | 9/1993 |
| JP | 02-163736 A | 6/1990 |
| JP | 05-045807 A | 2/1993 |
| JP | 60-162244 A | 8/1995 |
| JP | 10-133327 A | 5/1998 |
| JP | 10-197974 A | 7/1998 |

* cited by examiner

*Primary Examiner*—Thorl Chea
(74) *Attorney, Agent, or Firm*—Sughrue Mion, PLLC

(57) ABSTRACT

A transmission heat-development photosensitive material having an exposure wavelength of 750 nm or shorter having a property that an adsorbance of the material with respect to an exposing wavelength before an exposure and development process is 0.5 or smaller and a highest density of 2.8 can be realized with energy which is not larger than 7 times (in a case of a negative-type material) exposing energy required to realize a density of 1.2 or not smaller than 1/7 (in a case of a positive-type material) of the exposing energy.

9 Claims, 5 Drawing Sheets

TRANSMISSION HEAT-DEVELOPMENT PHOTOSENSITIVE MATERIAL

BACKGROUND OF THE INVENTION

1. Field of the Invention

The present invention relates to a transmission heat-development photosensitive material, and more particularly to a photosensitive material which is capable of preventing bleeding of the transmission heat-development photosensitive material.

2. Description of the Related Art

An image recording apparatus for recording a medical image for use in a digital radiography system, a CT, an MR or the like which uses a heat accumulating fluorescent sheet, is known. The foregoing apparatus employs a wet system for obtaining a reproduced image by performing a wet process after an image has been photographed or recorded on a silver-salt photographic photosensitive material.

In recent years, a recording apparatus has attracted attention which employs a dry system in which the wet process is not performed. Also the image recording apparatus adapted to the dry system records an image by irradiating (exposing) a photosensitive material with a laser beam so that a latent image is formed on the photosensitive material. The photosensitive material on which the latent image has been formed is heated so that the latent image is developed. The exposure is usually performed such that scanning (main scanning) with a laser beam is performed while the output of the laser beam is being controlled in accordance with image data obtained from an individual photographing process. As a matter of course, also the photosensitive material is moved in a predetermined direction (sub-scanning).

FIG. 7 shows a heat-development photosensitive material recording apparatus of the foregoing type which is a previous invention filed by the applicant of the present invention. Referring to FIG. 7, an image forming apparatus 10 is an apparatus arranged to use a heat development photosensitive material (hereinafter called a "recording material A") which does not require the wet development process. Moreover, scanning exposure using laser beam L is performed to expose the recording material A to correspond to a required image so that a latent image is formed. Then, heat development is performed so that a visible image is obtained. The image forming apparatus 10 comprises a recording-material supply section 12, a width aligning section 14, an image exposing section 16 and heat development section 18 disposed in this order in a direction in which the recording material A is conveyed. The recording-material supply section 12 has two sections having inside portions 22 and 24 to permit selective use of the recording materials A (for example, B4-size recording materials or half-cut recording materials) set in the foregoing sections. The recording material A is a recording material on which an image is recorded (exposed) by the laser beam L and which is developed with heat to develop color. In accordance with a print command, an uppermost recording material A in the magazine 100 selected by suction cups 26 and 28 structured to each sheet is taken out. Then, the recording material A is guided by paired supply rollers 30 and 32, paired conveying rollers 34 and 36 and conveying guides 38, 40 and 42 disposed downstream in the conveying direction so as to be conveyed to the width aligning section 14.

The width aligning section 14 aligns the position of the recording material A with a direction (hereinafter called a "widthwise direction") perpendicular to the conveying direction. In the downstream image exposing section 16, the width aligning section 14 performs alignment of the recording material A in the main scanning direction, that is, so-called side regist. Then, a conveying roller pair 44 conveys the recording material A to the downstream image exposing section 16.

The downstream image exposing section 16 uses a laser beam to expose the recording material A to correspond to the image, the image exposing section 16 incorporating an exposing unit 46 and a sub-scan conveying means 48.

FIG. 8 shows an example of the image exposing section 16.

Referring to FIG. 8, the image exposing section 16 incorporates:

(1) a first laser-beam source 50 having a semiconductor laser 50*a* for emitting laser beam L0 having a wavelength serving as a reference for a recording operation, a collimater lens 50*b* for converting the laser beams into a parallel luminous flux and a cylindrical lens 50*c*; and (2) a second laser-beam source 200 having a second semiconductor laser unit 200*a* for emitting laser beam L1 in a direction perpendicular to the direction of the optical axis of the first laser-beam source 50 and having a different wavelength from that of the first laser beam, a collimater leans 200*b* and a cylindrical lens 200C. Light emitted from each of the laser-beam sources 50 and 200 is allowed to pass through a polarizing beam splitter 202 so as to be formed into superimposed beams having the same phase. Then, the beams are allowed to pass through a reflecting mirror 204 so as to be made incident on a polygonal mirror 54. When the polygonal mirror 54 is rotated, the laser beam is applied in a main scanning direction b through a fθ lens 56 and a cylindrical mirror 58 while the laser beam is being polarized.

In response to an input image signal, a control unit (not shown) operate a driver 52 so as to rotate a conveying motor 206 provided for a polygonal mirror (a rotative polygonal mirror) 54 and a roller pair 62. Thus, while the recording material A is being scanned in the main scanning direction b with the laser beam, the recording material A is conveyed in a sub-scanning direction a.

The foregoing superimposed-wave optical system is an example. As a matter of course, the present invention is not limited to the foregoing system. Although semiconductor laser beam is employed in the foregoing description, the present invention is, as a matter of course, limited to this. Another laser beam, for example, He—Ne laser beam may, of course, be employed.

As a result, while the recording material A is being sequentially conveyed in the sub-scanning direction by the sub-scanning direction by the conveying motor 206 provided for the roller pair 60 and 62, a latent image having a predetermined outline is formed on the surface of the recording material A in the main scanning direction.

Referring again to FIG. 7, then, the recording material A caused to have the latent image formed by the image exposing section 16 shown in FIG. 8 is conveyed to the heat development section 18 by conveying roller pairs 64, 66 and 132. The heat development section 18 is a section for heating the recording material A to perform the heat development to convert the latent image into a visible image. A plate heater 320 accommodated in the heat development section 18 includes a heating member which is a plate-like heating member including a heating member, such as a nichrome wire, which is laid flatly. Thus, the development temperature for the recording material A is maintained. As shown in the drawing, the plate heater 320 projects upwards. Moreover, there are provided a supply roller 326 serving as a conveying means for relatively moving the recording material A with respect to the plate heater 320 while making the recording material A contact with the surface of the plate heater 320; and a pressing roller 322 which transmits heat from the plate heater 320 to the recording material A and disposed adjacent to the lower surface of the plate heater 320. Moreover, a heat insulating cover 325 for maintaining the temperature is disposed opposite to the plate heater 320 of the pressing roller 322.

As a result of the foregoing structure, the recording material A passes through a space between the pressing roller 322 and the plate heater 320 by dint of the conveying rotations of the supply roller 326. Then, the heat treatment is performed so that the recording material A is developed with heat. Then, the exposure process is performed so that the recorded latent image is converted into a visible image. Since the conveyance is performed such that the leading end is pressed against the plate heater 320, buckling of the recording material A can be prevented.

Although the plate heater has been described, the present invention is not limited to this. A means which uses another heat development method, for example, a heat drum+belt type means may, of course, be employed.

The recording material A discharged from the heat development section 18 is, by a conveying roller pair 140, guided to a guide plate 142. Then, the recording materials A are accumulated in a tray 146 through paired discharge rollers 144.

The heat development photosensitive material, which is the recording material A, will now be described.

FIG. 6 is a curvature showing a heat development photosensitive material. Referring to FIG. 6, the material incorporates, when viewed from the surface on which the laser beam L is made incident (from the upper portion of the drawing), a surface protective layer for protecting an image forming layer and preventing adhesion; the Em (emulsion) layer; a support-member layer (usually made of PET); and a back layer (and an AH (antihalation) layer in some cases).

The Em layer is an image forming layer formed on the surface of the support layer on which the laser beam L is made incident and containing a binder composed of latex at a ratio of 50% or higher and a reducing agent which is organic silver salt. When the image forming layer is exposed to incident laser beam L, a photocatalyst, such as photosensitive silver halide, forms a core for a latent image. When the core of the latent image is heated, the action of the reducing agent moves silver of the ionized organic silver salt so as to be bonded with the photosensitive silver halide and formed into crystal silver with which an image is formed. As the organic silver salt, silver salt of an organic acid, preferably silver salt of long-chain fatty carboxylic acid having 10 to 30 carbon atoms and organic or inorganic silver salt, the ligant of which has a stability factor coefficient of complex of 4.0 to 10.0 are exemplified. Specifically, the following materials are exemplified: silver salt of behenic acid, silver salt of arachidic acid, silver stearate, silver olerate, silver laurate, silver caproate, silver myristate, silver palmitate, silver maleate, silver fumarate, silver tartrate, silver linoleate, silver butyrate and silver camphorate. The image forming layer of the recording material contains a material, for example, photosensitive silver halide (hereinafter called "silver halide) which is converted into a photocatalyst after it has been exposed to light.

The image forming layer of the recording material or another layer on the same surface of the image forming layer may contain an additive which is known as a tone adjuster in a preferred quantity of 0.1 mol % to 50 mol % with respect to one mol of silver to raise the optical density. Note that the tone adjuster may be a precursor induced to have an effective function only when the development process is performed. The tone adjuster may be any one of a variety of known tone adjusters for use in the recording material. Specifically, the following materials are exemplified: a phthalimide compound, such as phthalimide or N-hydroyphthalimide; cyclic imide, such as succinimide, pyrazoline-5-on; naphthalic imide, such as N-hydroxy-1, 8-naphthalic imide; cobalt complex, such as cobalt hexamine trifluoroacetate; mercaptan, such as 3-mercapto-1,2,4-triazole or 2,4-dimercaptopyrimidine; phthalazinone derivative, such as 4-(1-naphtyl) phthalazinone; and its metal salt. The foregoing tone adjuster is added to the solution, which must be applied, as solution, powder or dispersed solid particles.

The sensitizing coloring matter must be capable of spectrosensitizing silver halide in a required wavelength region when the sensitizing coloring matter has been adsorbed to silver halide particles. To add the sensitizing color matter to the silver halide emulsion, it may directly be dispersed in the emulsion or it may be dissolved in single or a mixed solution of water, methanol, ethanol, N, N-dimethylformamide or the like, followed by adding the solution to the emulsion.

The surface protective layer is formed by an adhesion preventive material exemplified by wax, silica particles, elastomer-type block copolymer containing styrene (styrene-butadiene-styrene or the like), cellulose acetate, cellulose acetate butylate and cellulose propionate.

When the halation preventive dye is employed, any compound capable of satisfying the following requirement may be employed: the dye must be capable of performing required absorption in the wavelength and; the absorption must sufficiently be restrained in the visible region after the process has been completed; and a preferred absorbance spectrum shape of the antihalation layer can be obtained. Although the following materials are exemplified, the material is not limited to the following materials.

As a single dye, compounds disclosed in Japanese Patent Laid-Open No. 7-11432 and Japanese Patent Laid-Open No. 7-13295 are exemplified. As dyes which perform decoloration by carrying out processes, compounds disclosed in Japanese Patent Laid-Open No. 52-139136 and Japanese Patent Laid-Open No. 7-199409 are exemplified. It is preferable that the foregoing recording material has the image forming layer on either surface of the support member and a back layer on another surface.

To improve conveyance easiness, a matting agent may be added to the back layer. In general, the matting agent is in the form of particles of organic or inorganic compound which is dissoluble in water. The preferred organic compound is exemplified by water dissoluble vinyl polymer, such as polymethylacrylate, methyl cellulose, carboxy starch and carboxy nitrophenyl starch. The preferred inorganic compound is exemplified by silicon dioxide, titanium dioxide, magnesium dioxide, aluminum oxide and barium sulfate.

The binder for forming the back layer may be any one of a variety of colorless, transparent or semitransparent resins. The resin is exemplified by gelatin, arabic rubber, polovinyl alcohol, hydroxyethyl cellulose, cellulose acetate, cellulose acetate butylate, casein, starch, poly (metha) acrylate, polymethylmethacrylate and polyvinyl chloride.

It is preferable that the back layer is a layer, the maximum absorption is 0.3 to 2 in a required wavelength range. If necessary, the halation preventive dye for use in the foregoing antihalation layer may be added to the back layer.

When visible light is used to record an image on a photosensitive material having an exposing wavelength of 750 nm or shorter which is included in a visible region, required sharpness must be maintained to prevent halation and irradiation. To achieve this, visible-light absorbing dye which is an additive known as the color adjuster is employed. When the color developed by the foregoing dye is left at a high density in a case of a transmission-type material for use in a medical purpose or a printing purpose, there arises a problem in that a satisfactory quality cannot be realized. When, for example, recording in red is performed, cyan pigment for absorbing red is added to the photosensitive material. If the quantity of the cyan pigment is too large, excessive development of blue raises a problem. Therefore, the adsorbance of the dye must be lowered or a post process after the exposure must be performed to decolor the excessive color. Specifically, the post-process is performed by using a material obtained by adding pigment of a type which disappears with heat to the photosensitive material to cause the pigment to disappear with heat during the heat development. Since the dye enlarges the cost, minimizing the initial adsorbance has been performed. When the adsorbance of the dye is lowered, a process of recording a void Japanese character having a meaning corresponding to "white" in a black ground as shown in FIG. 1(A) results in bleeding to occur in the boundary of the white character as shown in FIG. 1(B). As a result, the white character cannot clearly be formed in the black ground.

When a black ground is recorded in a half tone portion as shown in FIG. 2(A), the half tone portions adjacent to the black ground encounters bleeding, as shown in FIG. 2(B). The reason why the foregoing bleeding phenomenon occurs has been detected as follows.

That is, referring to FIG. 6 which is a curvature showing a photosensitive material, a process for recording a half tone image (the left-hand portion of the drawing) is recorded adjacent to a black ground (the right-hand portion of the drawing) will now be considered. Although laser beam L1 having required exposing energy to form a required half tone is sufficient to sensitize the Em layer, laser beam L2 having recording energy for the adjacent black portion as shown in the drawing is reflected by a plurality of positions of the backlayer. Thus, a portion of the laser beam L2 is transmitted to the Em layer adjacent to the half tone portion, causing the Em layer to be sensitized.

To solve the above-mentioned problem, an object of the present invention is to provide a photosensitive material and a recording method is free from bleeding in a boundary when a void image is formed in a black ground or when a black ground is recorded in a half tone portion.

SUMMARY OF THE INVENTION

To solve the above-mentioned problem, according to an aspect of the present invention, there is provided a transmission heat-development photosensitive material having a structure that an adsorbance of the material with respect to an exposing wavelength before an exposure and development process is 0.5 or smaller and a highest density of 2.8 can be realized with energy which is not larger than 7 times (in a case of a negative-type material) exposing energy required to realize a density of 1.2 or not smaller than 1/7 (in a case of a positive-type material) of the exposing energy.

According to another aspect of the present invention, there is provided a transmission heat-development photosensitive material having a property that an adsorbance of the material with respect to an exposing wavelength before an exposure and development process is 0.5 or smaller and a highest density of 2.8 can be realized with energy which is not larger than 25 times (in a case of a negative-type material) exposing energy required to realize a lowest density +0.1 of the photosensitive material or not smaller than 1/25 (in a case of a positive-type material) of the exposing energy.

As described above, the photosensitive material is specified which is capable of forming a white image in a black portion (a lowest density) and/or a halftone image in a black portion (a highest density) in a state in which the hard gradation to a degree at which conspicuous irregurality in scanning can be prevented, is employed.

When the foregoing photosensitive material is employed, the difference between the exposing energy required to form a halftone image and the exposing energy required to realize the highest density with which a black image is formed can appropriately be reduced. Therefore, the contribution ratio of the halation caused from reflection from the backlayer can be lowered. Thus, bleeding in the boundaries can be prevented.

BRIEF DESCRIPTION OF THE DRAWINGS

FIG. 1 shows a state in which a void character is recorded in a black ground, in which

FIG. 2 shows a state in which a black portion is recorded in a halftone portion, in which

DESCRIPTION OF THE PREFERRED EMBODIMENTS

Embodiments of the present invention will now be described.

Figure 1A:
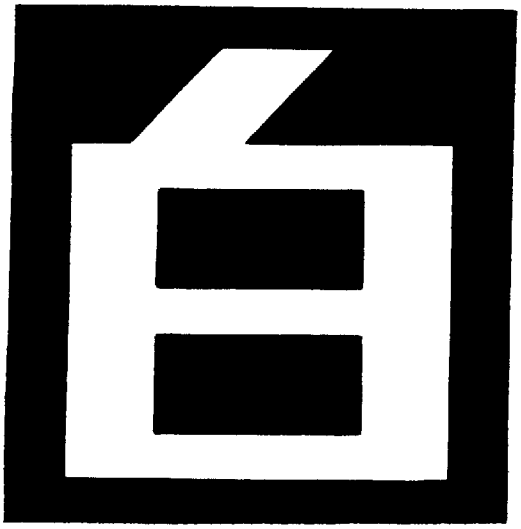
FIG. 1(A) shows a state according to the present invention and FIG. 1(B) shows a conventional state.
Figure 1B:
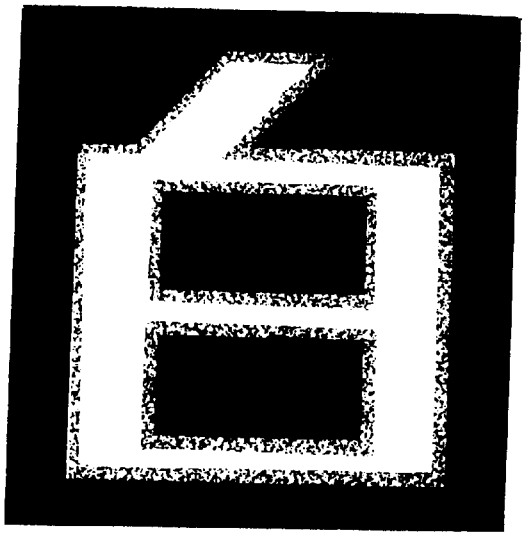
Figure 2A:
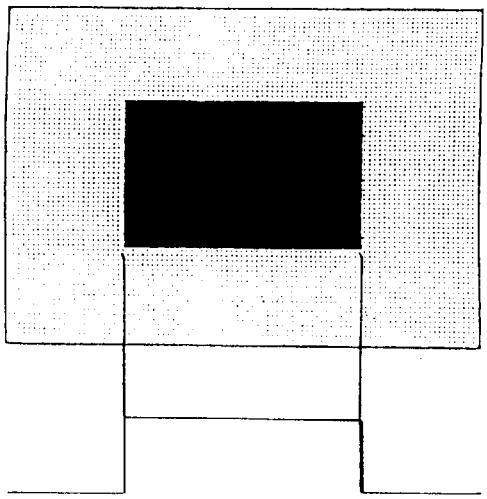
FIG. 2(A) shows a state according to the present invention and FIG. 2(B) shows a conventional state.
Figure 2B:
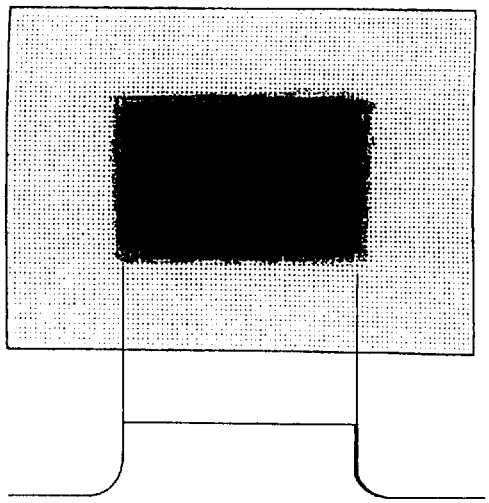
Figure 3:
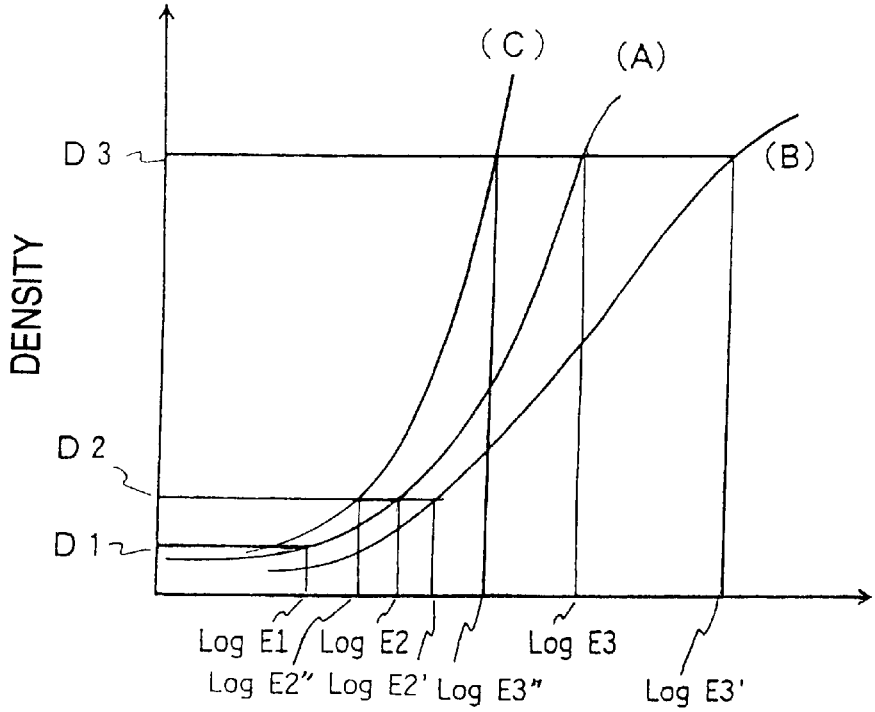
FIG. 3 is a graph showing sensitivity curves of a negative-type photosensitive material.

FIG. 3 is a graph showing a sensitivity curve of a negative-type photosensitive material and having an axis of ordinate standing for density D and an axis of abscissa standing for energy E indicated with log scales.

(1) E1 is exposing energy required to realize density D1=lowest density D min+0.1;

(2) E2 is exposing energy required to realize density D2=1.2; and (3) E3 is exposing energy required to realize highest density D3=2.8.

Figure 5:
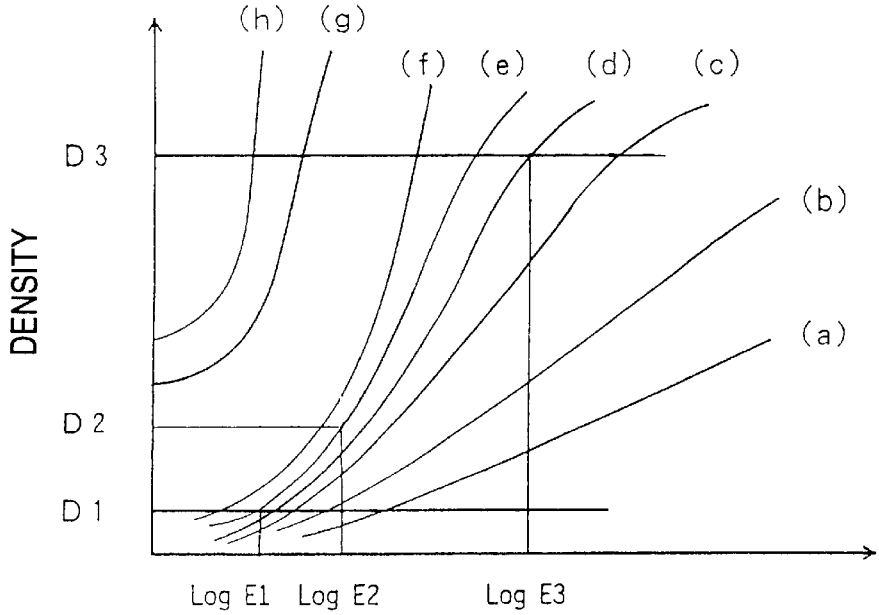
FIG. 5 is a graph showing sensitivity curves of a variety of negative-type photosensitive materials.
Figure 6:
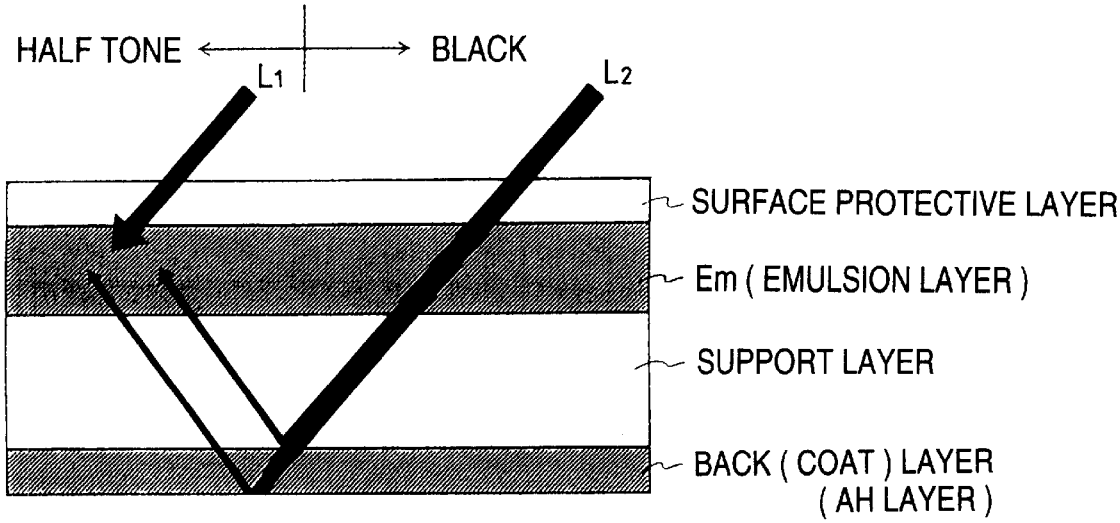
FIG. 6 is a cross sectional view showing a usual heat development photosensitive material.

The foregoing graph shows three curves (A), (B) and (C) having different gradients. In a case of a photosensitive material A expressed by the curve (A) having the steep gradient (also called "hard gradation), the exposing energy required to realize the intermediate density D2 is E2. A case will now be considered in which the exposing energy to realize the highest density D3 is E3. An assumption is made that the reflectance at the bottom surface of the photosensitive material is r %. In the foregoing case, irradiation of the photosensitive material as shown in FIG. 5 with a laser beam results in energy, which is in proportion to reflectance r % of the highest density energy E3 of the black ground, to cause halation to occur. As a result, reflection occurs so that the foregoing energy reaches the Em layer for the white or halftone portion.

In a case of photosensitive material B having the moderate gradient (also called "soft gradation") curve (B), exposing energy required to realize the intermediate density D2 is E2' and exposing energy required to realize the highest density D3 is E3'. As a result, reflection energy realized when the photosensitive material as shown in FIG. 5 has been irradiated with the laser beam is in proportion to E3'.

When the reflection energy of the two materials are compared with each other, the energy E3' of the photosensitive material B having a more moderate gradient as compared with the steep gradient of the photosensitive material A is larger than the energy E3. Therefore, the contribution ratio of the halation caused from the reflection is enlarged. Thus, the energy which reaches the Em layer of the halftone portion is enlarged. As a result, the density increases as compared with a predetermined halftone density, causing bleeding to occur.

Figure 8:
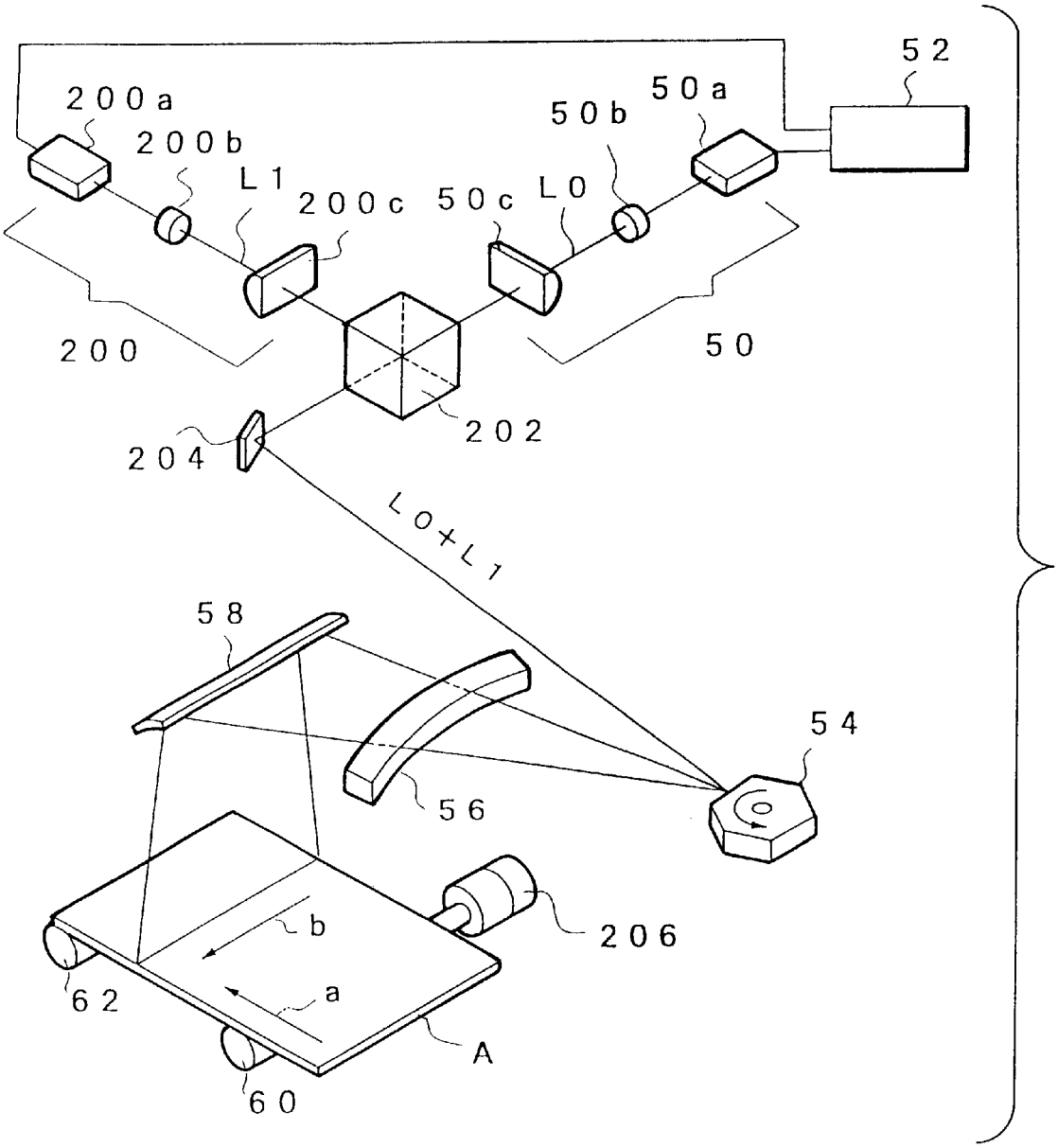
FIG. 8 is a diagram showing an example of an image exposing section 16 shown in FIG. 7.

In a case of photosensitive material C having the gradient curve (C) which is even steeper than the steep gradient curve (A), the exposing energy required to realize the intermediate density D2 is E2" and the energy of the highest density D3 is E3". Therefore, the contribution ratio of the halation of the photosensitive material C caused from reflection is lowered as compared with the photosensitive material A. Thus, bleeding can furthermore be prevented as compared with the photosensitive material A. The density is, however, considerably changed owning to a small change in the energy. Therefore, there arises a problem in that irregular density easily occurs when the pitch of the period of the number of planes has irregularity owning to the dispersion among the plane of the polygonal mirror 54 as shown in FIG. 8.

Therefore, a too steep gradient inhibits practical use.

An object of the present invention is to provide a photosensitive material having a gradient similar to that of the photosensitive material A.

Figure 4:
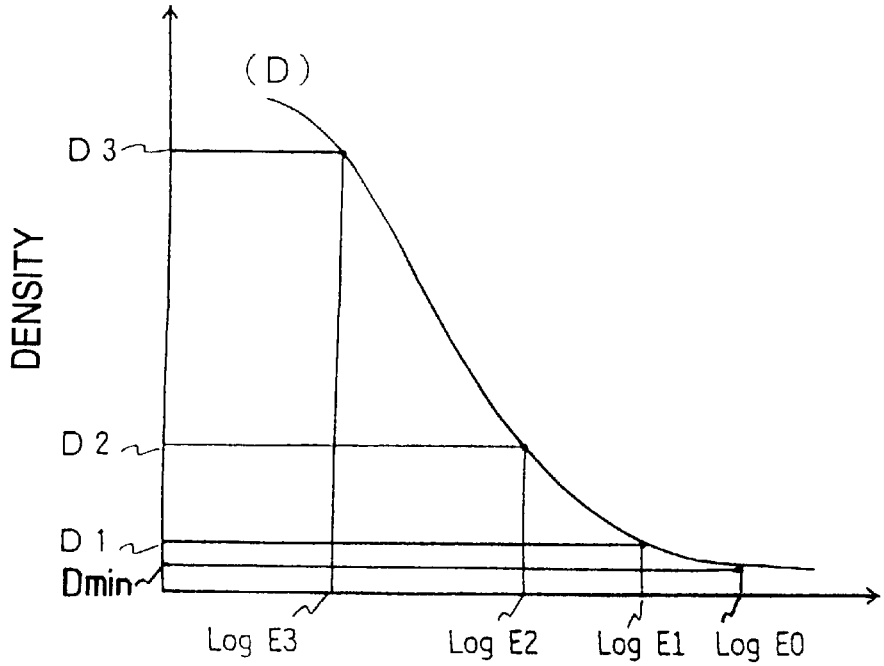
FIG. 4 is a graph showing sensitivity curves of a positive-type photosensitive material.

FIG. 4 is a graph showing a sensitivity curve of the positive-type photosensitive material (D) and having an axis of ordinate standing for the density D and an axis of abscissa standing for the energy E indicated with log scales.

(1) E1 is exposing energy required to realize density D1=lowest density D min+0.1;

(2) E2 is exposing energy required to realize density D2=1.2;

(3) E3 is exposing energy required to realize set highest density D3=2.8; and (4) E0 is minimum exposing energy to realize the lowest density D min.

The sensitivity curve of the positive-type photosensitive material (D) has similar characteristics as that of the sensitivity curve of the negative-type photosensitive material. That is, bleeding does not easily occur in the case of the photosensitive material having the steep gradient as compared with the photosensitive material having the moderate gradient. The photosensitive material having the excessively steep gradient is impractical.

A medical recording apparatus employed in the embodiment of the present invention will now be described.

(1) A negative-type dry silver transmission material incorporating a photosensitive material which is sensitized to a wavelength of 660 nm. The material incorporates an emulsion layer which contains dye having an adsorbance of 0.09 with respect to the wavelength of 660 nm and a backlayer which contains dye having an adsorbance of 0.45 with respect to a wavelength of 660 nm. The dye in the backlayer is heat decoloring dye which is completely decolored during the heat development so that the color disappears.

(2) A recording portion has a superimposition structure in which two semiconductor laser beams are superimposed each of which has a wavelength of 660 nm and a maximum output of 30 mW. A scanning optical system comprises a rotative polygonal mirror having six planes and arranged to rotate at 9012 rpm (the main scanning frequency is 901.2 Hz).

Main Scanning: a plane inclination correction using a fθ lens, a cylindrical lens and a cylindrical mirror. A scanning duty (a ratio of irradiation of the recording material when one scanning length is 100): 70% (a scanning width on the recording material: 356 mm).

Sub-Scanning: the photosensitive material is conveyed such that the surface of the focal point of the scanning optical system is conveyed in a direction perpendicular to the main scanning direction at conveyance speed of 22.53 mm/sec (scanning pitch: 25 $\mu$m).

Exposing Energy: 400 $\mu J/cm^2$ (3) Development Portion: the rear surface of the photosensitive material made contact with a plate heater heated to about 120° C. is slid on the plate heater for about 20 seconds so that development is performed.

Figure 7:
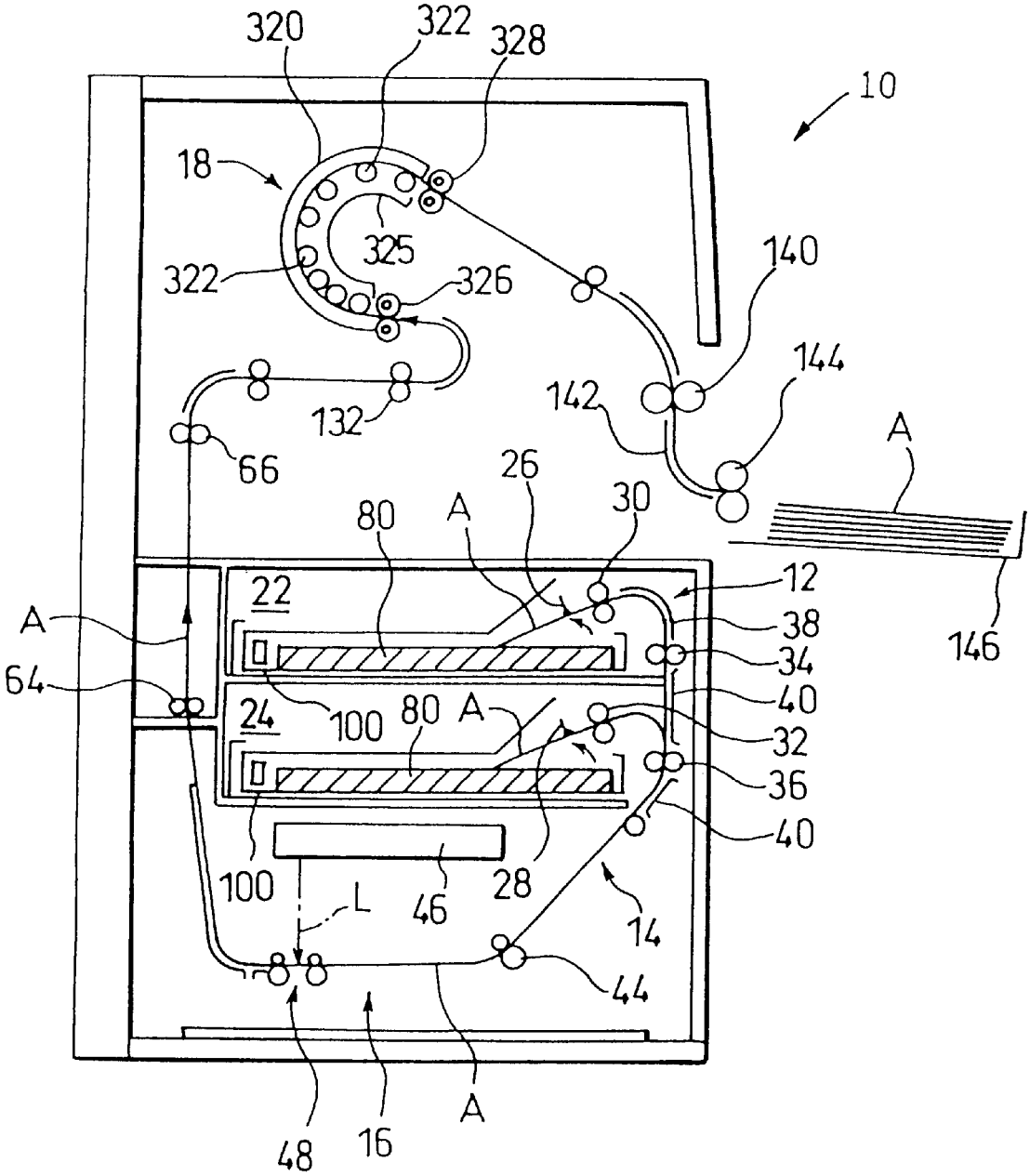
FIG. 7 is a diagram showing a heat development photosensitive material recording apparatus according to a previous invention of the applicant of the present invention.

(4) Overall Structure of Apparatus: same as the apparatus shown in FIG. 7.

The heat development is performed under a condition with which the lowest density D1 can be maintained and the highest density D3 can be recorded with the maximum exposing energy. Since the same photosensitive materials have considerably different sensitivity curves depending on the heating temperature and the heating duration, Dmin and Dmax of the photosensitive material which are conditions required for performing image diagnosis are satisfied. Moreover, also the recording apparatus for achieving the foregoing purpose is arranged to satisfy appropriate manufacturing conditions (each element can be available or manufactured at reasonable costs) in place of employment of a special apparatus.

The foregoing conditions are, for example, $$D\ min \leqq 0.25\ (preferably \leqq 0.2)$$

$$D\ max \geqq 2.5\ (preferably \geqq 3.0)$$

and $$\gamma \leqq 4\ (when\ D=1.2).$$

Specifically, heat development is performed in the ranges from 100° C. to 140° C. and from 10 sec to 40 sec.

One of the embodiments of the photosensitive material according to the present invention will now be described.

[Manufacturing of PET Support Member]

Terephtharic acid and ethylene glycol were employed and a usual process was performed so that PET having an intrinsic viscosity IV=0.66 (phenol/tetrachloroethane=6/4 (weight ratio) measured at 25° C.) was obtained. After the PET was pelleted, the pellet was dried at 130° C. for 4 hours. Then, the pellet was melted at 300° C., and then extruded from a T-type die. Then, rapid cooling was performed so that a non-oriented film having a thickness of 175 $\mu$m after heat fixation was obtained.

The film was vertically oriented to 3.3 times by using rolls having different peripheral speeds, and then a tenter was operated so that the film was laterally oriented to 4.5 times. The temperatures at the foregoing processes were 100° C. and 130° C., respectively. Then, heat fixation was performed at 240° C. for 20 seconds, and then relaxation was performed in the lateral direction by 4% at the foregoing temperature. Then, the chucking portion of the tenter was slitted, and then the two ends were knurled. Then, the film was wound up with 4 kg/cm$^2$ so that a roll having a thickness of 175 $\mu$m was obtained.

[Corona Process of the Surface]

A solid-state corona processing machine 6 KVA manufactured by Pillar was operated so that the two sides of the support member were processed for 20 m/minute at room temperature. In accordance with read values of electric current and voltage, a fact was found that the support member was subjected to a process of 0.375 kV·A·minute/m$^2$. At this time, the processing frequency was 9.6 kHz and the gap clearance between the electrode and the dielectric roll was 1.6 mm.

[Manufacturing of Undercoating Support Member]

(Preparation of Undercoating Solution A)

Pesresin A-515GB (30% manufactured by Takamatsu Oil) which was polyester copolymer dispersed in water in a quantity of 200 ml was added with 1 g of polystyrene particles (having an average particle size of 0.2 $\mu$m) and 20 ml of surface active agent 1 (1 wt %). Then, distilled water was added to enlarge the quantity of the solution to 1000 ml so that undercoating solution A was prepared.

Surface Active Agent 1

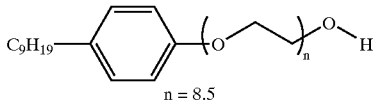

(Preparation of Undercoating Solution B)

Distilled water in a quantity of 680 ml was added with 200 ml of styrene-butadiene copolymer dispersed in water (styrene/butadiene/itaconic acid=47/50/3 (30 (weight ratio, density 30 wt %) and 0.1 g of polystyrene particles (having an average particle size of 2.5 $\mu$m). Then, distilled water was added to enlarge the quantity to 1000 ml so that undercoating solution B was prepared.

(Preparation of Undercoating Solution C)

Ten grams of enert gelatin were dissolved in 500 ml of distilled water, and then 40 g of composite particles of tin oxide-antimony oxide dispersed in water (40 wt %) disclosed in Japanese Patent Laid-Open No. 61-20033 was added to the foregoing solution. Then, distilled water was added to enlarge the quantity to 1000 ml so that undercoating solution C was prepared.

(Preparation of Undercoating Support Member)

The foregoing corona discharge process was performed, and then the undercoating solution A was applied by using a bar coater such that the amount of coating in a wet state was 5 ml/m$^2$. Then, the solution was dried at 180° C. for 5 minutes. The dry thickness was 0.3 $\mu$m. Then, the reverse side (the back surface) was subjected to the corona discharge process. Then, the undercoating solution B was applied by using a bar coater such that the amount of coating in a wet state was 5 ml/m$^2$ and a dry thickness was about 0.3 $\mu$m. Then, the solution was dried at 180° C. for 5 minutes. Then, the undercoating solution C was applied by using a bar coater such that the amount of coating in a wet state was 3 ml/m$^2$ and a dry thickness was about 0.03 $\mu$m. Then, the solution was dried at 180° C. for 5 minutes so that an undercoating support member was manufactured.

[Preparation of Organic Acid Silver]

Initially, 117 ml of 1N-NaOH solution was added in 55 minutes to a solution which was being stirred at 79° C. and which was composed of 43.8 g of Behenic acid manufactured by Henkel (Trade name: Edenor C22-85R), 730 ml of distilled water and 60 ml of tert-butanol. Thus, reactions were performed for 240 minutes. Then, 112.5 ml of water solution of 19.2 g silver nitrate was added in 45 minutes, followed by allowing the solution to stand for 20 minutes so that the temperature was lowered to 30° C. Then, suction filtration was performed to separate solid components, followed by washing the solid components with water until the conductivity of filtered water was 30 $\mu$S/cm. As an alternative to drying of the thus-obtained solid components, the solid components were used as a wet cake such that 7.4 g of polyvinyl alcohol (trade name: PVA-205) and water were added to the wet cake corresponding to 100 g of the dry solid component so that the overall quantity was made to be 385 g. Then, the solution was previously dispersed by a homomixer.

Then, the stock solution subjected to the previous dispersion was processed three times by a disperser (trade name: Microfluidizer M-110S-EH manufactured by MicroFluidex International Corporation and having G10Z interaction chamber), the pressure of which was set to 1750 kg/m$^2$. Thus, dispersed behenic acid silver B was obtained. The thus-obtained dispersed behenic acid silver contained needle behenic acid silver particles, the average minor axis of which was 0.04 $\mu$m, the average major axis of which was 0.8 $\mu$m and a coefficient of variation of which was 30%. The particle size was measured by Master SizerX manufactured by Malvern Instruments Ltd. The cooling operation was performed such that a coiled heat exchanger was joined to each of the front and rear ends of the instruction chamber to adjust the temperature of the refrigerant so as to set a required dispersion temperature.

[Preparation of Reducing Agent Dispersed by 25%]

Slurry was obtained by adding 176 g of water to 80 g of 1,1-bis(2-hydroxy-3,5-dimethylphenyl)-3,5,5-trimethylhexane and 64 g of 20% water solution of denatured poval MP203 manufactured by Kuraray and by sufficiently mixing the solution. Then, 800 g of zirconia beads having an average diameter of 0.5 mm was prepared and injected into a vessel together with the slurry. Then, a disperser (¼G sandgrinder mill manufactured by Imex) was operated so that the solution was dispersed for 5 hours. Thus, a dispersed reducing agent was obtained. The thus-obtained dispersed reducing agent contained particles of the reducing agent which had an average particle size of 0.72 $\mu$m.

[Preparation of Mercapto Compound Dispersed by 20%]

Slurry was obtained by adding 224 g of water to 64 g of 3-mercapto-4-phenyl-5-heptyl-1,2,4-triazole and 20% water solution of 32 g of denatured poval MP203 manufactured by Kuraray and by sufficiently mixing the solution. Then, 800 g of zirconia beads having an average diameter of 0.5 mm was prepared and injected into a vessel together with the slurry. Then, a disperser (¼G sandgrinder mill manufactured by Imex) was operated so that the solution was dispersed for 10 hours. Thus, a dispersed mercapto compound was obtained. The thus-obtained dispersed mercapto compound contained particles of the mercapto compound which had an average particle size of 0.67 $\mu$m.

[Preparation of Organic Polyhalogen Compound Dispersed by 30%]

Slurry was obtained by adding 224 g of water to 48 g of tribromomethylphenylsulfon, 48 g of 3-tribromomethylsulfonyl-4-phenyl-5-tridecyl-1,2,4-triazole and 20% water solution of 48 g of denatured poval MP203 manufactured by Kuraray and by sufficiently mixing the solution. Then, 800 g of zirconia beads having an average diameter of 0.5 mm was prepared and injected into a vessel together with the slurry. Then, a disperser (¼G sandgrinder mill manufactured by Imex) was operated so that the solution was dispersed for 5 hours. Thus, a dispersed organic polyhalogen compound was obtained. The thus-obtained dispersed organic polyhalogen compound contained particles of the dispersed organic polyhalogen particles which had an average particle size of 0.74 μm.

[Preparation of Methanol Solution of Phthalazine Compound]

Dissolution of 26 g 6-isopropyl phthalazine in 100 ml of methanol was performed.

[Preparation of Pigment Dispersed by 20%]

Slurry was obtained by adding 250 g of water to 64 g of C. I. Pigment Blue 60 and 6.4 g of Demol N manufactured by Kao and by sufficiently mixing the solution. Then, 800 g of zirconia beads having an average diameter of 0.5 mm was prepared and injected into a vessel together with the slurry. Then, a disperser (¼G sandgrinder mill manufactured by Imex) was operated so that the solution was dispersed for 25 hours. Thus, dispersed pigment was obtained. The thus-obtained dispersed pigment contained pigment particles which had an average particle size of 0.21 μm.

[Preparation of Silver Halide Particle 1]

While solution obtained by adding 6.7 cc of 1 wt % potassium bromide solution to 1421 cc of distilled water and by adding 8.2 cc of 1N nitric acid and 21.8 g of gelatin phthalate was being stirred in a reaction pot made of stainless steel coated with titanium, the temperature of the solution was maintained at 35° C. Then, distilled water was added to 37.04 g of silver nitrate so as to be diluted to have a volume of 159 cc so that solution a1 was prepared. Moreover, solution b1 was prepared by diluting 32.6 g of potassium bromide with distilled water to make the volume to be 200 cc. A controlled double jet method was employed to add the overall quantity of the solution a1 at a predetermined flow rate in one minute while pAg was being maintained at 8.1 (the solution b1 was added by the controlled double jet method). Then, 30 cc of 3.5% hydrogen peroxide solution was added, and then 33.6 cc of 3 wt % solution of benzoimidazole was added. Then, solution a2 was obtained by diluting the solution a with distilled water to make the volume to be 317.5 cc and solution b2 were prepared. Moreover, solution b2 was obtained by dissolving hexachloriridium dipotassium in the solution b1 to finally be $1\times10^{-4}$ mole for each mole of silver, followed by enlarging the quantity of the solution to 400 cc which was two times the quantity of the solution b1 by dilution using distilled water. The solutions a2 and b2 were used. The controlled double jet method was also employed to add the overall quantity of the solution a2 at a predetermined flow rate for 10 minutes while pAg was being maintained at 8.1 (the solution b2 was added by the controlled double jet method). Then, 0.5% methanol solution of 2-mercapto-5-methylbenzoimidazole in a quantity of 50 cc was added. Then, pAg was raised to 7.5 by using silver nitrate, and then 1N sulfuric acid was used to adjust the pH to 3.8. Then, stirring was interrupted, and then precipitation/desalting/washing with water were performed. Then, 3.5 g of deionized gelatin was added, and 1N sodium hydroxide was added to realize pH 6.0 and pAg 8.2. Thus, dispersed silver halide was prepared.

Particles of silver halide emulsion were silver bromide particles having an average sphere-equivalent diameter of 0.031 μm and a coefficient of variation of the sphere-equivalent diameter of 11%. The particle size and so forth were obtained from an average of 1000 particles by using an electron microscope. The ratio of plane {100} of the particles was 85% detected by a Kubelka-Munk method.

While the emulsion was being stirred, the temperature was raised to 50° C., and then 5 cc of 0.5 wt % methanol solution of N,N' dihydroxy-N", N"-dimethylmelamine and 5 cc of 3.5 wt % methanol solution of phenoxyehtanol were added. After a lapse of one minute, benzenesulfonsodium was added by $3\times10^{-5}$ moles for each mole of silver. After a lapse of two minutes, the following spectrosensitizing pigment 1 in the form of a dispersed solid form (gelatin solution) was added by $5\times10^{-3}$ moles for each mole of silver. After a lapse of two minutes, the following tellurium compound was added by $5\times10^{-5}$ moles for each mole of silver, and then the solution was maturated for 50 minutes. Then, 2-mercapto-5-methylbenzoimidazole was added by $3\times10^{-3}$ moles just before completion of the maturation so that the temperature was lowered to complete the chemical sensitization. As a result, silver halide particle 1 was manufactured.

Sensitizing Pigment 1

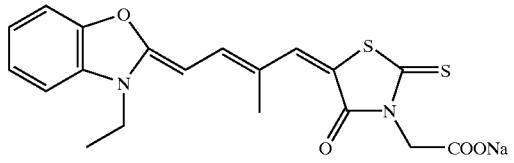

Tellurium Compound

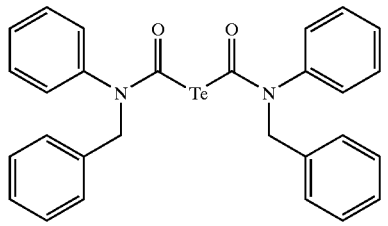

[Preparation of Silver Halide Particle 2]

Water in a quantity of 700 ml was added with 22 g of gelatin phthalate and 30 mg of potassium bromide, and pH was adjusted to 5.0 at a temperature of 35° C. Then, 159 ml of solution containing 18.6 g of silver nitrate and 0.9 g of ammonium nitrate and solution containing potassium bromide and potassium iodide at a molar ratio of 92:8 were added for 10 minutes by the controlled double jet method while pAg was being maintained at 7.7. Then, 476 ml of solution containing 55.4 g of silver nitrate and 2 g of ammonium nitrate and solution containing, in each litter, $1\times10^{-5}$ moles of hexachloriridium dipotassium and 1 mole of potassium bromide were added for 30 minutes by the controlled double jet method while pAg was being maintained at 7.7. Then, 1 g of 4-hydroxy-6-methyl-1,3,3a,7-tetrazaindene was added, and then pH was lowered to cause flocculating setting to occur. Then, a desalting process was performed. Then, 0.1 g of phenoxyethanol was added, and then pH was adjusted to 5.9 and pAg was adjusted to 8.2. Thus, preparation of silver iodine bromide (cubic particles having a structure that cores containing iodine was 8 mol %, the average of the same was 2 mol %, the average size was 0.05 μm, the coefficient of variation of the projected area was 8% and the ratio of plane {100} was 88%) was completed.

The thus-obtained silver halide particles were heated to 60° C. Then, 85 μmol of sodium thiosulfate, $1.1\times10^{-5}$ moles of 2,3,4,5,6-pentafluorophenyl diphenylphosphine selenide, $1.5\times10^{-5}$ moles of a tellurium compound, $3.5\times10^{-8}$ moles of gold chloride and $2.7\times10^{-4}$ moles of thiocyanic acid were added for each mole of silver. Then, maturation was performed for 120 minute, and then the temperature was quickly lowered to 40° C. Then, $1\times10^{-4}$ moles of the sensitizing pigment 1 and $5\times10^{-4}$ moles of 2-mercapto-5-methylbenzoimidazole were added, and then the temperature was quickly lowered to 30° C. Thus, silver halide emulsion 2 was obtained.

[Preparation of Silver Halide 3]

Dissolution of 22 g of gelatin phthalate and 30 mg of potassium bromide in 700 ml of water was performed. Then, pH was adjusted to 5.0 at a temperature of 35° C. Then, 159 ml of solution containing 18.6 g of silver nitrate and 0.9 g of ammonium nitrate and solution containing potassium bromide and potassium iodide at a molar ratio of 92:8 were added in 10 minutes by the controlled double jet method while pAg was being maintained at 7.7. Then, 687 ml of solution containing 284 g of silver nitrate and 2 g of ammonium nitrate and solution containing hexachloriridium dipotassium and 1 mole of potassium bromide in one litter were added in 150 minutes by the controlled double jet method while pAg was being maintained at 7.7. Then, 1 g of 4-hydroxy-6-methyl-1,3,3a,7-tetrazaindene was added. Then, pH was lowered to cause flocculating setting to occur. Then, a desalting process was performed. Then, 0.1 g of phenoxyethanol was added, and then pH was adjusted to 5.9 and pAg was adjusted to 8.2. Thus, preparation of silver iodine bromide (cubic particles having a structure that cores containing iodine was 8 mol %, the average of the same was 0.5 mol %, the average size was 0.08 μm, the coefficient of variation of the projected area was 12% and the ratio of plane {100} was 88%) was completed.

The thus-obtained silver halide particles were heated to 60° C. Then, 85 μmol of sodium thiosulfate, $1.1\times10^{-5}$ moles of 2,3,4,5,6-pentafluorophenyl diphenylphosphine selenide, $1.5\times10^{-5}$ moles of a tellurium compound, $3.5\times10^{-8}$ moles of gold chloride and $2.7\times10^{-4}$ moles of thiocyanic acid were added for each mole of silver. Then, maturation was performed for 120 minute, and then the temperature was quickly lowered to 40° C. Then, $1\times10^{-4}$ moles of the sensitizing pigment 1 and $5\times10^{-4}$ moles of 2-mercapto-5-methylbenzoimidazole were added, and then the temperature was quickly lowered to 30° C. Thus, silver halide emulsion 3 was obtained.

[Preparation of Emulsion Coating Solution]

The thus-obtained dispersed organic acid silver in a quantity of 103 g and 20 wt % water solution of 5 g of polyvinylalcohol PVA-205 (manufactured by Kuraray) were mixed with each other, and the temperature of the solution was maintained at 40° C. Then, 23.2 g of the reducing agent dispersed by 25%, 4.8 g of the pigment C. I. Pigment Blue 60 dispersed in water by 5%, 10.7 g of an organic polyhalide dispersed by 30% and 3.1 g of mercapto compound dispersed by 20% were added to the foregoing solution. Then, 106 g of 40 wt % Styrene-butadiene rubber ("SBR") latex, the temperature of which was maintained at 40° C. and which was refined with UF, was added, and then the solution was sufficiently stirred. Then, 6 ml of methanol solution of phthalazine compound was added so that solution containing the organic acid silver was obtained. The silver halide particles 1, 2 and 3 were previously and sufficiently mixed with one another at ratios shown in Table 1. Immediately before the coating operation, a static mixer was operated to mix the foregoing particles with the solution containing the organic acid silver so that coating solution for forming the emulsion layer was prepared. The solution was directly supplied to a coating die to make the amount of the silver which must be applied to be 1.4 g/m$^2$.

TABLE 1

| Photo-sensitive Material | Quantity of Silver Halide Particles (g) Particle 1 | Particle 2 | Particle 3 | Gradation | E3/E2 | E3/E1 | γ | Missing Bleeding | Character | Irregularity |
|---|---|---|---|---|---|---|---|---|---|---|
| 1 | 10 | 0 | 0 | Hard | 3.0 | 10 | 4.3 | ○ | ○ | x |
| 2 | 0 | 10 | 0 | | | | | | | |
| 3 | 0 | 0 | 12 | | | | | | | |
| 4 | 1 | 8 | 1 | | | | | | | |
| 5 | 8 | 2 | 0 | | 4.0 | 17 | 3.6 | ○ | ○ | Δ |
| 6 | 0 | 2 | 8 | | | | | | | |
| 7 | 5 | 5 | 0 | Medium | 7.0 | 25 | 3.0 | Δ | Δ | ○ |
| 8 | 0 | 5 | 5 | | | | | | | |
| 9 | 5 | 0 | 5 | Soft | 10 | 40 | 2.2 | x | x | ○ |
| 10 | 3.5 | 3.5 | 3.5 | | | | | | | |

Criteria: ○: Excellent, Δ: Acceptable, x: Unsatisfactory

The viscosity of the coating solution for forming the emulsion layer was measured by a B-type viscometer manufactured by Tokyo Keiki. The viscosity was 85 [mPa·s] at 40° C.

The viscosity of the coating solution at 25° C. was measured by using RFS Fluid Spectrometer manufactured by Reometrix Far East was as follows:

When the shearing speed was (1) 0.1, (2) 1, (3) 10, (4) 100 and (5) 1000 [1/second], the viscosity was (1) 1500, (2) 220, (3) 70, (4) 40 and (5) 20 [mPa·s].

The SBR latex refined with UF was obtained as follows.

The following SBR latex was diluted to ten times with distilled water, then the latex solution was diluted and refined until the ion conductivity was 1.5 mS/cm by using an UF-refining module FS03-FC-FUY03Al (Daisen Membrane System). The concentration of the latex was 40%. (SBR latex: latex St (68)-Bu (29)-AA (3)). The average particle size was 0.1 μm, the concentration was 45%, the ion conductivity was 4.2 mS/cm (the ion conductivity was measured such that stock solution (40%) of latex was measured at 25° C. by using a conductivity meter CM-30S manufactured by Toa Electric Wave). The pH was 8.2.

[Preparation of Coating Solution for Forming Intermediate Layer of Emulsion Surface]

(Intermediate Coating Solution)

Initially, 772 g of 10 wt % solution of polyvinyl alcohol PVA-205 (manufactured by Kuraray), 226 g of 27.5% latex solution of methylmethacrylate/styrene/2-ethylhexylacrylate/hydroxiethylmethacrylate/acrylic acid copolyer (weight ratio of the copolymer: 59/9/26/5/1) were added with 2 ml of 5 wt % solution of aerosol OT (manufactured by American Cyanamide), 4 g of benzyl alcohol, 1 g of 2,3,4-trimethyl- 1,3-pentanediol monoisobutyrate and 10 mg of benzointhiazolinone. Thus, a coating solution for forming the intermediate layer was prepared which was then supplied to a coating die such that the quantity was 5 ml/m$^2$.

The viscosity of the coating solution was 21 [mPa·s] at 40° C. measured by the B-type viscometer.

[Preparation of Coating Solution for Forming First Layer of Protective Layer for Emulsion Surface]

(Coating Solution for Forming First Layer of Protective Layer for Emulsion Surface)

Inert gelatin in a quantity of 80 g was dissolved in water. Then, 138 ml of 10% methanol solution of phthalic acid, 28 ml of 1N sulfuric acid, 5 ml of 5 wt % solution of aerosol OT (manufactured by American Cyamide) and 1 g of phenoxymethanol were added. Then, water was added to make the total quantity to be 1000 g so that a coating solution was prepared. Then, the coating solution was supplied to a coating die such that the quantity was 10 ml/m$^2$.

The viscosity of the coating solution was 17 [mPa·s] at 40° C. measured by the B-type viscometer.

[Preparation of Coating Solution for Forming Second Layer of Protective Layer of Emulsion Surface]

(Coating Solution for Forming Second Layer of Protective Layer)

Inert gelatin in a quantity of 100 g was dissolved in water. Then, 20 ml of 5% solution of N-perfluorooctylsulfonyl-N-propylalanine potassium salt, 16 ml of 5 wt % solution of aerosol OT (manufactured by American Cyamide), 25 g of polymethylmethacrylate particles (having an average particle size of 4.0 $\mu$m), 44 ml of 1N sulfuric acid and 10 mg of benzoilthiazoline were added with water so that the total quantity was made to be 1555 g. Solution in a quantity of 445 ml containing 4 wt % chrome alum and 0.67 wt % phthalic acid and the foregoing solution were mixed by a static mixer immediately before the coating operation so that coating solution for forming the surface protective layer was prepared. Then, the solution was supplied to a coating die such that the quantity was 10 ml/m$^2$.

The viscosity of the coating solution was 9 [mPa·s] at 40° C measured by the B-type viscometer.

(Preparation of Coating Solution for Back Surface)

[Preparation of Solid Particle Dispersed Solution of Basic Precursor]

The following basic precursor compound in a quantity of 64 g and 10 g of a surface active agent Demor N manufactured by Kao were mixed with 246 ml of distilled water. The mixed solution was bead-dispersed by using a sandmill (¼ Gallon sand grinder mill manufactured by Amemix) so that dispersed solution of solid particles of basic precursor having an average particle size of 0.2 $\mu$m was prepared.

Basic Precursor Compound

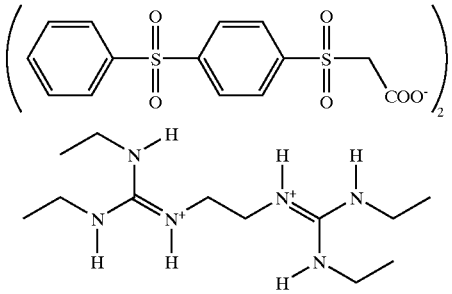

(Preparation of Dispersed Solution of Solid Particle of Dye)

The following cyanin dye compound in a quantity of 9.6 g and 5.8 g of p-alkylbenzene sodium sulfonate were mixed with 305 ml of distilled water. The mixed solution was bead-dispersed by using a sandmill (¼ Gallon sand grinder mill manufactured by Amemix) so that dispersed solution of solid particles of basic precursor having an-average particle size of 0.2 $\mu$m was prepared.

Cyanine Dye Compound

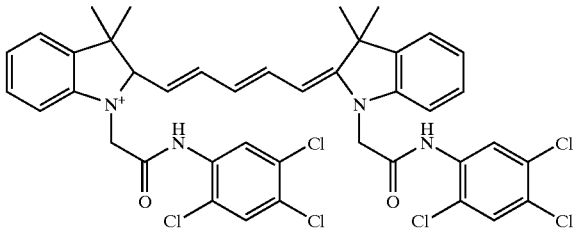

(Preparation of Coating Solution for Forming Antihalation Layer)

Gelatin in a quantity of 17 g, 9.6 g of polyacrylamide, 70 g of the solid particle dispersed solution of basic precursor, 56 g of the foregoing solid particle dispersed solution of the dye, 1.5 g of polymethylmethacrylate particles (having an average particle size of 6.5 $\mu$m), 2.2 g of polyethylene sodium sulfonate, 0.2 g of 1% solution of the following coloring dye compound and 844 ml of H2O were mixed with one another. Thus, coating solution for forming a halation preventive layer was prepared.

Coloring Dye Compound

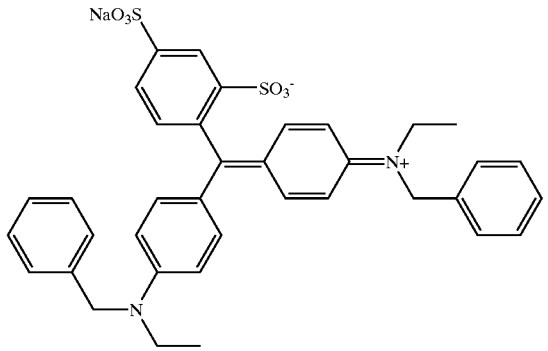

(Preparation of Coating Solution for Forming Protective Layer)

The temperature of a container was maintained at 40° C. Then, 50 g of gelatin, 0.2 g of polystyrene sodium sulfonate, 2.4 g of N,N'-ethylene bis (vinylsulfonacetoamide), 1 g of t-octylphenoxyethoxyethane sodium sulfonate, 30 mg of benzoilthiazolinone, 32 mg of C8F17SO3K, 64 mg of C8F17SO2N (C3H7)(CH2CH2O)4(CH2)4-SO3Na and 950 ml of H2O were mixed with one another. Thus, coating solution for forming the protective layer was prepared.

[Preparation of Heat Development Photosensitive Material]

The support member coated with the foregoing under coating solution was coated with the coating solution for forming a halation preventive layer so that the quantity of the solid component of the applied solid particle dye was 0.04 g/m$^2$. Moreover, the coating solution for forming the protective layer such that the quantity of applied gelatin was 1 g/m$^2$. The foregoing solutions were simultaneously applied to form multiple layers. Then, the solutions were dried so that the halation preventive backlayer was formed. Then, the emulsion layer, the intermediate layer, the first layer of the protective layer and the second layer of the same were, in this sequential order, applied to the surface opposite to the back surface by a slide bead coating method. That is, simultaneous and multiple-layer coating was performed. Thus, a sample of the heat development photosensitive material was manufactured. Note that the support member was not wound up after the back surface was coated. Then, the emulsion surface was applied.

The coating operation was performed at a speed of 160 m/min. The distance from the leading end of the coating die and the support member was made to be 0.18 mm. The pressure in a decompression chamber was made to be lower than the atmospheric pressure by 392 Pa. In a next tilling zone, wind, the temperature of the dry bulb of which was 18° C. and that of a wet bulb of which was 12° C., was blown at an average wind speed of 7 m/second for 30 seconds so that the coating solution was cooled. Then, a drying wind, the temperature of the dry bulb of which was 30° C. and that of the wet bulb of which was 18° C., was blown in a helix floating-type drying zone such that the blowing out wind speed from an opening was 20 m/second for 200 seconds. Thus, the solvent in the coating solution was volatilized.

Ten types of photosensitive materials obtained by mixing and coating the foregoing silver halide particles 1, 2 and 3 at the ratios shown in Table 1 were evaluated. Thus, results shown in Table 1 were obtained.

(1) The photosensitive material 1 obtained by adding the silver halide 1 in a quantity of 10 g had E3/E2 which was 3.0, E3/E1 which was 10 and the gradient γ of 4.3. Therefore, a considerably steep gradient (hard gradation) was realized. Therefore, satisfactory characteristics against bleeding and missing of a character can be realized. However, the too hard gradation causes excessive irregularity to occur. Therefore, a satisfactory result was not obtained.

(2) The photosensitive material 2 was obtained by adding the silver halide particle 2 by 10 g, the photosensitive material 3 was obtained by adding the silver halide particle 3 by 12 g and the photosensitive material 4 was obtained by adding the silver halide particles 1, 2 and 3 by 1 g, 8 g and 1 g, respectively. Similarly to the photosensitive material 1, E3/E2 was 3.0, E3/E1 was 10 and the gradient γ was 4.3. Therefore, each material had hard gradation. Therefore, excessive irregularity occurs. As a result, satisfactory results were not obtained.

(3) The photosensitive material 5 was obtained by silver halide particles 1 and 2 by 8 g and 2 g, respectively. The photosensitive material 6 was obtained by adding the silver halide particles 2 and 3 by 2 g and 8 g, respectively. Therefore, E3/E2 was 4.0, E3/E1 was 17 and the gradient γ was 3.6. Therefore, a somewhat hard gradient was realized. Thus, satisfactory characteristics against bleeding and missing of a character were realized. Moreover, the degree of irregularity was acceptable.

(4) The photosensitive material 7 was obtained by adding the silver halide particles 1 and 2 by 5 g each. The photosensitive material 8 was obtained by adding the silver halide particles 2 and 3 by 5 g each. Thus, E3/E2 was 7.0, E3/E1 was 25 and the gradient γ was 3.0. The realized gradation was medium gradation. Therefore, characteristics against bleeding and missing of a character were acceptable. Moreover, no irregularity was observed. Thus, satisfactory results were obtained.

(5) The photosensitive material 9 was obtained by adding the silver halide particles 1, 2 and 3 by 5 g, 0 g and 5 g, respectively. The photosensitive material 10 was obtained by adding the same by 3.5 g, 3.5 g and 3.5 g, respectively. In the foregoing case, the gradation was too soft to prevent bleeding and missing of a character.

When the sensitivity curves of the negative-type photosensitive material shown in FIG. 5 are observed, the photosensitive materials 1 to 4 correspond to the curve (f), the photosensitive materials 5 and 6 correspond to the curve (e), the photosensitive materials 7 and 8 correspond to the curve (d) and the photosensitive materials 9 and 10 correspond to the curve (c).

As a result, the following conclusion can be derived.

When Dmin is 0.20 such that the Dmax is 2.8, (1) The materials having E3/E2 of 4 to 7 are able to satisfactorily prevent bleeding. The material having E3/E2 of 10 is unsatisfactory to prevent bleeding.

(2) The materials having E3/E1 of 17 to 25 are able to satisfactorily prevent missing of a character. The material having E3/E1 of 40 cannot satisfactorily prevent missing of a character.

(3) When the gradation gradient γ of the foregoing satisfactory materials in a case where D=1.2 satisfies $\gamma=\Delta D/\Delta \log E \geqq 4$, irregularity of the pitches of the period of the number of the planes of the rotative polygonal mirror becomes conspicuous. In this case, scanning irregularity cannot satisfactorily be prevented. That is, if the reflectance of each of the six planes of the rotative polygonal mirror is not the same or if each plane is inclined, the period of the number of the planes easily encounters the irregularity. If the gradation is too hard, the irregularity can easily visibly be confirmed. In the foregoing case, unsatisfactory results were obtained when $\gamma>4$.

That is, as for the negative-type heat development photosensitive material, in a case of halftone, it can be defined that the highest density of 2.8 can be realized with exposing energy which is seven times or smaller the exposing energy required to realize the density of 1.2. In a case of a void character, it can be defined that the highest density of 2.8 can be realized with exposing energy which is 25 times or smaller the exposing energy required to realize the lowest density.

The reason why the adsorbance has the upper limit (0.5 or smaller and a highest density of 2.8) lies in the fact that an adsorbance larger than the foregoing value causes color remanent and fog to occur. In this case, the commercial value deteriorates.

As for the positive-type heat development photosensitive material, the same fact is applied. Therefore, it can be defined that the exposing energy which is not smaller than 1/7 of the exposing energy required to realize the density 1.2 is able to realize the highest density of 2.8 in a case of the halftone. As for missing of a character, it can be defined that the exposing energy which is not smaller than 1/25 of the exposing energy required to realize the lowest density +0.1 of the photosensitive material is able to realize the highest density of 2.8.

When the density is 1.2, excessively steep gradient γ of the D-Log E curve must be avoided. In both of the-negative-type and the positive-type, it is preferable that the absolute value of the gradient is 4 or smaller.

It is preferable that the lowest density is 0.25 or lower, more preferably 0.2 or lower. The reason for this lies in that a material having a high lowest density suffers from unsatisfactory prevention of missing of a character. That is, the commercial value and the diagnosing performance of the foregoing material are unsatisfactory.

The heat development photosensitive material of the type having the antihalation AH layer, the color of which disappears owning to the post process which is performed after the exposure, applies the foregoing facts.

The reason why the lower limit (0.2 or larger and a highest density of 2.8) of the adsorbance lies in the fact that the adsorbance smaller than the foregoing value deteriorates the effect of dying.

It is preferable that the absorption density of a laser beam for the Em layer is 0.2 or smaller, more preferably 0.1 or smaller. The reason for this lies in that the dying density cannot easily be raised because a variety of substances for developing color are contained in the emulsion layer. Moreover, the decoloration cannot easily be performed owning to a technical limitation. Therefore, an assumption is made that no decoloration is performed and the density must be low.

It is preferable that the exposing energy E3 required to realize the highest density in the case of the negative-type material and the energy E0 required to realize the lowest density in the case of the positive-type material is 700 $\mu J/cm^2$ or smaller. The reason for this lies in that a visible ray-region laser, the cost of which is reasonable and which can be available at the moment of the application, is 50 mW or smaller. The laser power which can be obtained on the sensitive material in a case of the two-wave superimposition which is a relatively easy method from a technical viewpoint is about 50×2×0.75 mW (the value of 0.75 is the efficiency of the optical system). To reduce the size of the apparatus, the focal distance of the laser scanning optical system cannot be elongated. In a case where the shorter side of a half-cut size (the length of scan is 356 mm) which is a usual size for the medical film is scanned, the scanning duty is not higher than 70%. When the foregoing recording is performed in 20 seconds, the maximum energy which can be used in the irradiation is about 700 $\mu J/cm^2$. Therefore, to manufacture a low-cost apparatus, the energy of E3≦700 $\mu J/cm^2$ is required for the negative-type material. In the case of the positive-type material, the energy of E0≦700 $\mu J/cm^2$ is required.

It is preferable that the highest density for the heat development photosensitive material is 3.0 or higher.

The most preferred heat development photosensitive material has the structure that a binder, organic salt, the reducing agent and the silver halide are contained on the support member.

As described above, the photosensitive material according to the present invention causes the gradation of the photosensitive material to be somewhat hard to medium gradation in place of the too hard or too soft gradation. Therefore, the contribution ratio of the halation caused from reflection of a laser beam can be lowered. Therefore, the necessity of using a large quantity of light-source wavelength absorbing dye, which is a high cost material, can be eliminated to prevent unsatisfactory results of forming a white character in a black ground and bleeding of a halftone portion adjacent to a black portion. Therefore, an image having a high quality and exhibiting an excellent commercial value and diagnosing performance can be recorded.

What is claimed is:

1. A transmission heat-development negative photosensitive material comprising:

a support member; and an emulsion layer provided on said support member, said emulsion layer containing a binder, an organic silver salt, a reducing agent, and silver halide;

wherein said transmission heat-development negative photosensitive material has (1) an adsorbance with respect to an exposing wavelength before an exposure and development process that is no more than 0.5 and (2) a highest density of 2.8 that is achievable with energy which is no more than 7 times of an exposing energy required to achieve a density of 1.2;

wherein said binder is Styrene-butadiene rubber.

2. A transmission heat-development negative photosensitive material according to claim 1, wherein a gradient γ (an absolute value) of a D-Log E curve is no more than 4 at the density of 1.2.

3. A transmission heat-development negative photosensitive material comprising:

a support member; and an emulsion layer provided on said support member, said emulsion layer containing a binder, an organic silver salt, a reducing agent, and silver halide;

wherein said transmission heat-development negative photosensitive material has (1) an adsorbance with respect to an exposing wavelength before an exposure and development process is no more than 0.5 and (2) a highest density of 2.8 that is achievable with energy which is no more than 25 times of an exposing energy required to achieve a lowest density +0.1;

wherein said binder is Styrene-butadiene rubber.

4. A transmission heat-development negative photosensitive material, comprising:

a support member;

an emulsion layer provided on said support member, said emulsion layer containing a binder, an organic silver salt, a reducing agent, and silver halide; and an antihalation layer AH, which is decolored in a post process after exposure, provided on said support member;

wherein said transmission heat-development negative photosensitive material has (1) an adsorbance with respect to an exposing wavelength before an exposure and development process that is no less than 0.2 and (2) a highest density of 2.8 that is achievable with energy which is no more than 7 times of an exposing energy required to achieve a density of 1.2;

wherein said binder is Styrene-butadiene rubber.

5. A transmission heat-development negative photosensitive material according to claim 4, wherein a gradient γ (an absolute value) of a D-Log E curve is no more than 4 at the density of 1.2.

6. A transmission heat-development negative photosensitive material, comprising:

a support member;

an emulsion layer provided on said support member, said emulsion layer containing a binder, an organic silver salt, a reducing agent, and silver halide; and an antihalation layer AH, which is decolored in a post process after exposure, provided on said support member;

wherein said transmission heat-development negative photosensitive material has (1) an adsorbance with respect to an exposing wavelength before an exposure and development process that is 0.2 or larger and (2) a highest density of 2.8 that is achievable with energy which is not larger than 25 times exposing energy required to achieve a lowest density +0.1;

wherein said binder is Styrene-butadiene rubber.

7. A transmission heat-development negative photosensitive material according to any one of claims 1, 3, 4 or 6, wherein a laser-beam absorption density of said emulsion layer is no more than 0.2.

8. A transmission heat-development negative photosensitive material according to any one of claims 1, 3, 4 or 6, wherein an exposing energy E3 required to achieve the highest density satisfies E3$\leqq$700 $\mu$J/cm$^2$.

9. A transmission heat-development negative photosensitive material according to any one of claims 1, 3, 5 or 6, wherein an exposure wavelength of said transmission heat-development photosensitive material is no more than 750 nm.

* * * * *